US007664413B2

(12) United States Patent
Kobayashi et al.

(10) Patent No.: US 7,664,413 B2
(45) Date of Patent: Feb. 16, 2010

(54) IMAGE FORMING DEVICE INCLUDING A TONER PATTERN FORMING UNIT

(75) Inventors: Kazumi Kobayashi, Tokyo (JP); Kohta Fujimori, Kanagawa (JP); Shin Hasegawa, Kanagawa (JP); Nobutaka Takeuchi, Kanagawa (JP); Takashi Enami, Kanagawa (JP); Kiichirou Shimizu, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 481 days.

(21) Appl. No.: 11/600,712

(22) Filed: Nov. 17, 2006

(65) Prior Publication Data

US 2007/0116483 A1 May 24, 2007

(30) Foreign Application Priority Data

Nov. 18, 2005 (JP) ..... 2005-334412

(51) Int. Cl.
*G03G 15/00* (2006.01)
*G03G 15/01* (2006.01)
*G03G 15/16* (2006.01)

(52) U.S. Cl. ..... 399/49; 399/72; 399/101; 399/301

(58) Field of Classification Search ..... 399/49, 399/72, 101, 301, 302, 346, 350; 347/116
See application file for complete search history.

(56) References Cited

U.S. PATENT DOCUMENTS

| | | | | |
|---|---|---|---|---|
| 5,463,455 | A * | 10/1995 | Pozniakas et al. | 399/350 |
| 5,970,282 | A * | 10/1999 | Yanagida et al. | 399/101 |
| 6,542,713 | B2 * | 4/2003 | Jones et al. | 399/346 |
| 7,493,072 | B2 * | 2/2009 | Sato et al. | 399/301 |
| 7,505,704 | B2 * | 3/2009 | Facci et al. | 399/346 |

FOREIGN PATENT DOCUMENTS

| | | |
|---|---|---|
| JP | 2004-046001 | 2/2004 |
| JP | 2005-234358 | 9/2005 |
| JP | 2006-220846 | 8/2006 |

* cited by examiner

*Primary Examiner*—William J Royer
(74) *Attorney, Agent, or Firm*—Harness, Dickey & Pierce

(57) ABSTRACT

An image forming device includes a toner pattern forming unit that forms a first toner pattern and a second toner pattern downstream of the first toner pattern along a direction of advance of an intermediate transfer belt on the intermediate transfer belt. The first toner pattern is configured to include color patches of which a color density gradually differs so that, when detected by a sensor, a fluctuation of a toner density is adjusted by a feedback data. The second toner pattern is configured to prevent a cleaning blade from being twisted by a friction of the intermediate transfer belt due to the toner lubrication.

7 Claims, 5 Drawing Sheets

RELATED ART

IMAGE FORMING DEVICE INCLUDING A TONER PATTERN FORMING UNIT

CROSS-REFERENCE TO RELATED APPLICATIONS

The present document incorporates by reference the entire contents of Japanese priority document, 2005-334412 filed in Japan on Nov. 18, 2005.

BACKGROUND OF THE INVENTION

1. Field of the Invention

The present invention relates to an image forming device that forms a toner image on a recording medium, especially to the image forming device that forms more than two toner patterns on an intermediate transfer belt, one toner pattern being configured to be detected for a feedback control thereof and another to lubricate a cleaning blade rubbing the intermediate transfer belt.

2. Description of the Related Art

An electro-photographic technique has been extensively employed in an image forming device. In an electro-photographic image forming device, an electrostatic latent image is formed on a photoreceptor. The electrostatic latent image is developed into a toner image by a developing device. The toner image is transferred onto a paper sheet so as to form an image on the sheet.

A tandem-type image forming technique has been also extensively employed in the image forming device. In a tandem image forming device, image forming units for yellow (Y), magenta (M), cyan (C), and black (K), which respectively include the photoreceptor and the developing device, are arranged in a tandem manner so as to form one color image.

The tandem image forming device achieves higher productivity in printing compared with an image forming device that switches the developing device. Therefore, the tandem image forming device has become popular.

However, there is a problem in the tandem image forming device. The image forming units for Y, M, C, and K colors in the tandem image forming device are respectively independent from one another. Therefore, when Y, M, C, and K toner images formed by the image forming units are transferred onto a transfer position, a transfer fluctuation causes, namely, a fluctuation in a color registration due to a displacement of scanning positions in optical scanners for Y, M, C, and K colors. As a result, the image quality of the tandem image forming device degrades significantly. Furthermore, the image quality may degrade significantly because of differences in a toner density of the toner images formed by the image forming units for Y, M, C, and K colors.

Thus, in the tandem image forming device, it is necessary to detect the fluctuations in the color registration and the toner density at predetermined time intervals, and to correct the fluctuations.

A toner pattern such as a pattern for adjusting color matching, as shown in FIG. 4, is used for detecting the fluctuation in the color registration. A toner pattern such as a pattern for controlling an image forming process, as shown in FIG. 3, is used for detecting the fluctuation in the toner density. The toner patterns include color patch groups of the Y, M, C, and K toner images, and are formed on a movable unit such as an intermediate transfer belt.

The toner patterns are scanned by an optical sensor. A position and the density of each toner patch of the scanned toner patterns are detected by a processing section, and an amount of fluctuations in both the color registration and the toner density in the toner images are calculated. The fluctuation in color registration is corrected by adjusting a timing of writing and the toner density in each color toner image according to the amount of fluctuations.

The image forming device, disclosed in Japanese Patent Application Laid-open No. 2004-46001, corrects the fluctuation in the color registration by forming a toner pattern. In the image forming device, when a pattern for correcting the fluctuation in the color registration is formed entirely on the movable unit such as the intermediate transfer belt, the optical sensor detecting a fluctuation in the color registration, of which a gap is formed small that is between the color patches of the pattern for correcting the fluctuation in the color registration. Therefore, the fluctuation in the color registration can be corrected with a high accuracy.

Recently, the image forming device forms a pattern for preventing blade-twisting of a toner pattern for maintaining a cleaning function of a cleaning device that cleans the intermediate transfer belt.

The pattern formed of the toner for preventing blade-twisting inhibits and prevents a cleaning blade from a twisting caused by an increase of a friction between the intermediate transfer belt and the cleaning blade. The toner pattern for preventing blade-twisting is used as a lubricant to an edge portion of the cleaning blade contacting to the intermediate transfer belt. Therefore, the pattern for preventing blade-twisting prevents the cleaning blade from twisting.

Japanese Patent Application Laid-open No. 2005-234358 discloses the image forming device that forms the pattern for preventing blade-twisting. In the image forming device, reflective photo sensors are arranged in the middle and both sides of a photosensitive drum. The reflective photo sensors detect the density of a toner attached to a non-image-forming area. The image forming device forms the pattern for preventing blade-twisting depending on the size of a transfer paper sheet. The pattern for preventing blade-twisting supplies an appropriate amount of the toner to the edge portion between the intermediate transfer belt and the cleaning blade. Thus, the image forming device can prevent a cleaning error, and further can prevent the cleaning blade from twisting.

The pattern for process controlling, which detects a fluctuation in the toner density, includes the color patches of which color density is gradually changing as shown in FIG. 4. When the toner pattern for process controlling is to be formed, a developing bias and a charging bias need to be changed gradually.

FIG. 8 is a diagram of the toner patterns for explaining an image forming device in a related art. Amounts of the biases are different from that of normal printing. After the last patch of the pattern for process controlling is formed, the amounts of those biases are returned back to the same for normal printing. However, at this time, a scumming, which is a strip-formed toner scum on an intermediate transfer belt, generates due to adopting the electro-photographic technique. FIG. 8 depicts the scumming which occurs after the pattern for process controlling is formed.

When the pattern for color matching by the feedback adjustment is formed next to the pattern for process controlling, the scumming needs to be cleaned before the pattern for color matching is formed. If the reflective photo sensors detect the scumming, the image forming device executes a correction of a displacement. Therefore, the corrected image is displaced significantly.

On the other hand, when the image forming device forms a toner pattern that performs properly even though the scumming occurs, a time for cleaning is wasted needlessly. Thus, the productivity of the image forming device disadvantageously decreases.

SUMMARY OF THE INVENTION

It is an object of the present invention to at least partially solve the problems in the conventional technology.

According to an aspect of the present invention, an image forming device including an electro-photographic image forming unit and an intermediate transfer belt, the electro-photographic image forming unit configured to form a toner image onto the transfer belt, and the transfer belt configured to transfer the toner image onto a transfer medium, the image forming device includes, a toner pattern forming unit forms a first toner pattern and a second toner pattern downstream of the first toner pattern along a direction of advance of the intermediate transfer belt on the transfer belt, the first toner pattern including color patches of which a color density gradually differs so that a fluctuation of a toner supplying density can be detected by a sensor for a feedback adjustment of the fluctuation, and the second toner pattern for preventing a cleaning blade from being twisted by a friction from the intermediate transfer belt, when scrubbing, due to a toner-lubricating function thereof so as to maintain a cleaning ability of the cleaning blade.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

An exemplary embodiment of the present invention is described in detail below with reference to accompanying drawings.

Figure 1:
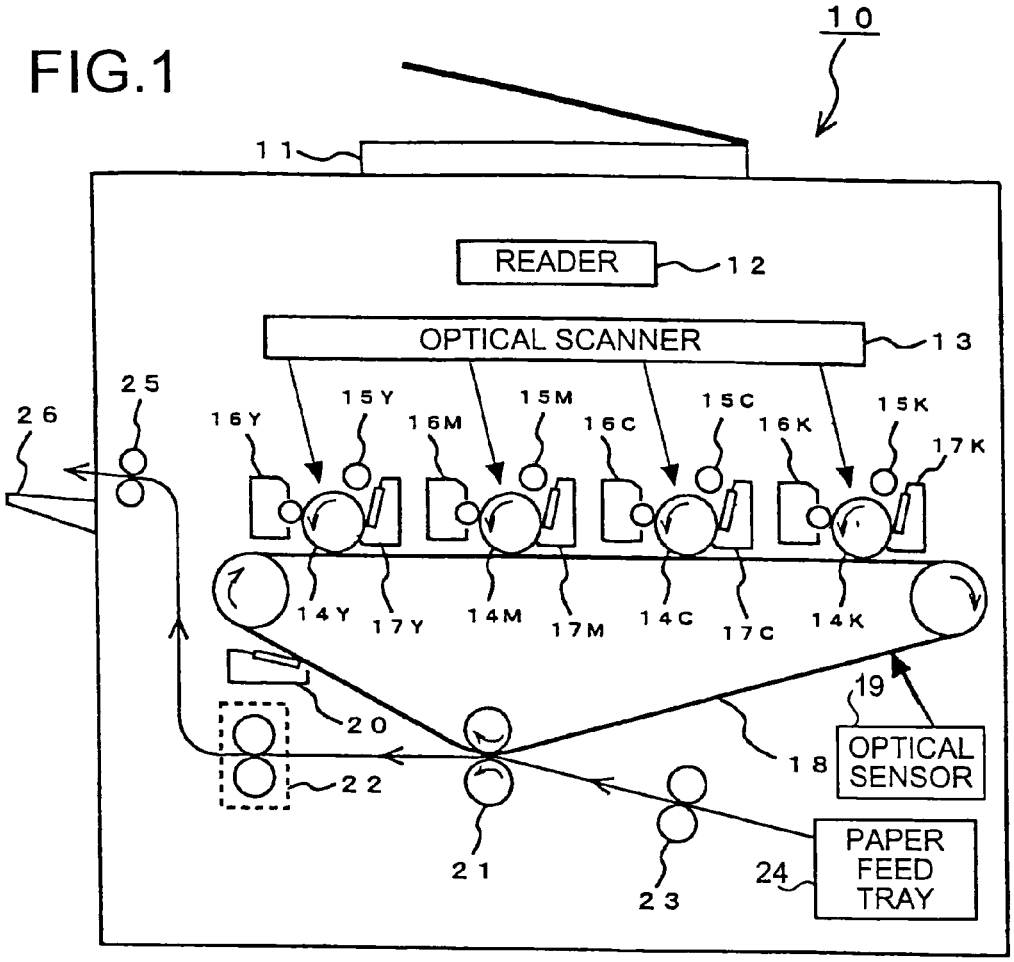
FIG. 1 is a side view of an image forming device according to an embodiment of the present invention.

FIG. 1 is a side view of an image forming device 10 according to an embodiment of the present invention. A configuration of the image forming device 10 according to the embodiment is described with reference to FIG. 1.

The image forming device 10 employs a tandem-color style. The image forming device 10 forms toner images for yellow (Y), magenta (M), cyan (C), and black (K) colors, and overlaps the toner images so as to form a full-color image. The image forming device. 10 includes an original glass plate 11, a reader 12, an optical scanner 13, photosensitive drums 14 (Y, M, C, K), roller charging devices 15 (Y, M, C, K), developing devices 16 (Y, M, C, K), drum cleaning devices 17 (Y, M, C, K), an intermediate transfer belt 18, an optical sensor 19, a transfer belt cleaning device 20, paired transfer rollers 21, a fixing device 22, paired feed rollers 23, a paper feed tray 24, paired copy receiving rollers 25, and a copy receiving tray 26.

The original glass plate 11 is a plate on which a document to be printed, namely, subjected to reading is placed. An undersurface of the original glass plate 11 is formed by a contact glass.

The reader 12 reads the document placed on the original glass plate 11 such that the reader 12 illuminates the document with a laser beam through the contact glass, and receives the reflected laser beam from the document.

The optical scanner 13 projects a laser beam to the photosensitive drums 14 (Y, M, C, K) for writing based on the document information read by the reader 12.

The photosensitive drums 14 (Y, M, C, K) are drum-shaped image carriers, and have the same diameter respectively. The photosensitive drums 14 (Y, M, C, K) are arranged at even intervals, and pressurized by the intermediate transfer belt 18.

Each photosensitive drum 14 is surrounded by the roller charging device 15, the developing device 16, the intermediate transfer belt 18, the drum cleaning device 17, and a neutralization device (not shown) along a rotating direction of the photosensitive drum 14. The photosensitive drum 14 is illuminated with the laser beam for writing by the optical scanner 13 through a gap between the roller charging device 15 and the developing device 16.

The roller charging devices 15 (Y, M, C, K) are roller-shaped devices, and respectively arranged near, but not to contact to the photosensitive drum 14. The roller charging device 15 charges a surface of the photosensitive drum 14. When the surface of the photosensitive drum 14 is projected with the laser beam for writing by the optical scanner 13, an electrostatic latent image is formed on the photosensitive drum 14.

The developing devices 16 (Y, M, C, K) respectively include a developing roller, and the developing roller is arranged to contact the photosensitive drum 14. The developing devices 16 (Y, M, C, K) respectively hold a toner (a developer) corresponding to the photosensitive drums 14 (Y, M, C, K). When an electrostatic latent image is formed on the photosensitive drum 14, the developing device 16 supplies the toner to the photosensitive drum 14, so that the electrostatic latent image is developed to a toner image.

The drum cleaning devices 17 (N, M, C, K) respectively include a blade, which is a cleaning blade. Hereinafter, the suffix Y, M, C, and K will be abbreviated, which signifies each unit for Y, M, C, and K colors are configured to be the same except for the color of the color toner each unit uses. The cleaning blade is arranged to contact the photosensitive drum 14. After the toner image is transferred onto the intermediate transfer belt 18, the drum cleaning device 17 cleans the surface of the photosensitive drum 14 by removing and collecting a residual toner, paper chips, or the like therefrom.

The neutralization device (not shown) is provided between the drum cleaning device 17 and the roller charging device 15. The neutralization device neutralizes the surface of the photosensitive drum 14.

The intermediate transfer belt 18 is of a loop belt that the toner images formed on the photosensitive drums 14 are transferred thereto. The toner images are overlapped sequentially so as to form a full-color image on the intermediate transfer belt 18.

The optical sensor 19 is configured not to contact the intermediate transfer belt 18. The optical sensor 19 detects a toner pattern formed as a test pattern for a maintenance work of the image forming device 10. More specifically, the optical sensor 19 detects the toner patterns including a pattern for process controlling, a pattern for color matching, and the like. Those toner patterns are described in detail later.

The transfer belt cleaning device 20 includes a blade, which is a cleaning blade, and the blade is configured to contact the intermediate transfer belt 18. After the toner images are transferred onto a recording paper sheet, the transfer belt cleaning device 20 cleans a surface of the intermediate transfer belt 18 by removing and collecting a residual toner and the toner patterns therefrom.

The paired transfer rollers 21 transfer the full-color image formed on the intermediate transfer belt 18 onto the recording paper sheet fed from the paper feed tray 24. The fixing device 22 fixes the transferred full-color image at high temperature onto the recording paper sheet.

The paired feed rollers 23 feed the recording paper sheet. The paper feed tray 24 stores the recording paper sheet with respect to each size of the recording paper sheet. The paired copy receiving rollers 25 discharge the recording paper sheet that the full-color image is thermally fixed thereto to outside the image forming device 10. The copy receiving tray 26 is a tray that the discharged recording paper sheet is placed thereon.

All of the photosensitive drums 14 rotate in the same direction. The intermediate transfer belt 18 rotates in a direction opposite to the rotating direction of the photosensitive drums 14. One of the paired transfer rollers 21, shown in a lower part of the pair which is located outside the intermediate transfer belt 18, rotates in an opposite direction to the moving direction of the intermediate transfer belt 18, which is the same direction with the rotating direction of the photosensitive drums 14. In FIG. 1, the photosensitive drums 14 and the outside transfer roller 21 rotate counterclockwise, and the intermediate transfer belt 18 rotates clockwise.

Figure 2:
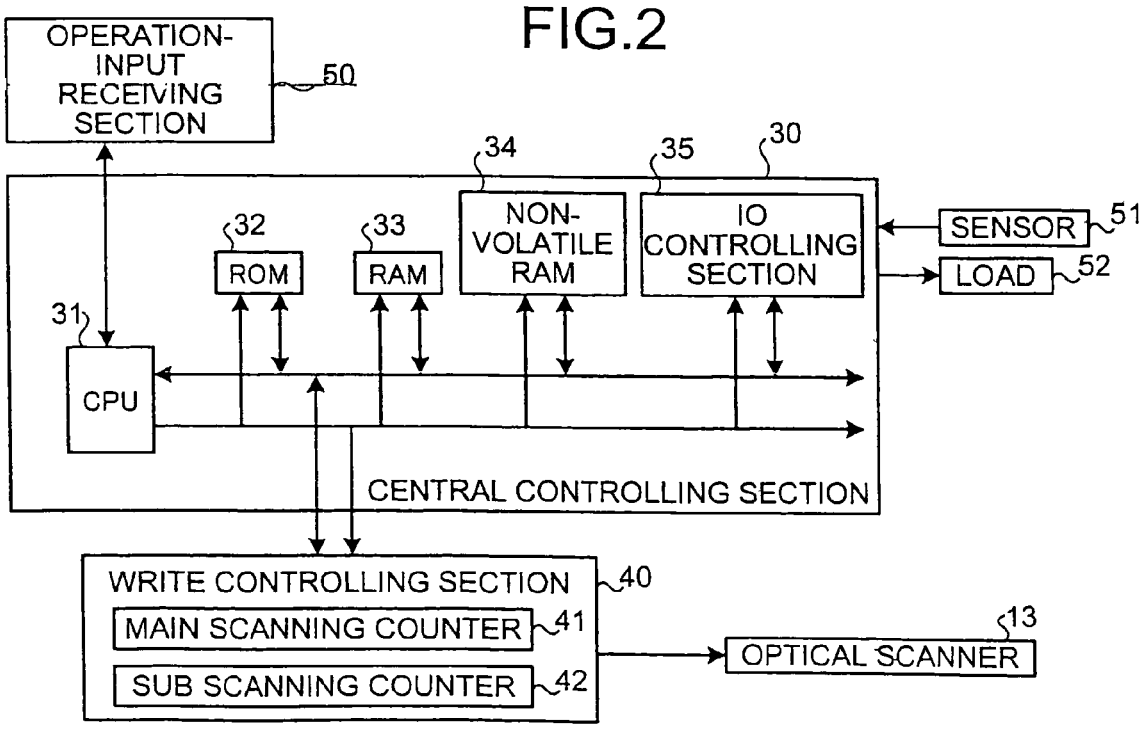
FIG. 2 is a schematic for explaining a system configuration of the image forming device shown in FIG. 1.

FIG. 2 is a schematic for explaining a system configuration of the image forming device 10 shown in FIG. 1.

The image forming device 10 includes a central controlling section 30, a write controlling section 40, and an operation input receiving section 50.

The central controlling section 30 controls the image forming device 10 entirely. The central controlling section 30 includes a central processing unit (CPU) 31, a read-only memory (ROM) 32, a random access memory (RAM) 33, a nonvolatile RAM 34, and an input-output (IO) controlling section 35.

The CPU 31 develops a program stored on the ROM 32 to the RAM 33, and executes a data processing, an arithmetic processing, or the like being based on the developed program.

The ROM 32 is a nonvolatile memory, and stores programs, data, parameters, and the like for which the CPU 31 executes processing or controlling.

The RAM 33 is a memory that a user can freely write on a program or data stored thereon. The RAM 33 provides a working area that is required when the CPU 31 executes processing or controlling the programs, data, parameters, or the like.

The nonvolatile RAM 34 is a memory on which adjusted values of control, timing, and the like, or registered conditions and parameters for setting the copying mode are stored. Those adjusted values and the registered conditions and parameters are stored on the RAM 34 even though the image forming device 10 is turned off, because the RAM 34 is a nonvolatile memory.

The IO controlling section 35 controls a load 52 according to an input from a sensor 51 included in the image forming device 10.

The write controlling section 40 includes a main scanning counter 41 and a sub scanning counter 42. The write controlling section 40 controls the optical scanner 13 to write data according to count values of the main scanning counter 41 and the sub scanning counter 42 so as to form an electrostatic latent image being based on the scanned data, which corresponds to the contents of the document read by the reader 12. Furthermore, the write controlling section 40 controls the optical scanner 13 so as to from an electrostatic latent image corresponding to a toner pattern instructed by the CPU 31.

The main scanning counter 41 is cleared by a synchronization signal in the main scanning direction, and outputs a count value that is counted in synchronization with a pixel clock. The sub scanning counter 42 is cleared by an output instruction from the CPU 31, and outputs a count value that is counted in synchronization with the synchronization signal in the main scanning direction.

The operation input receiving section 50 receives an operation input from an outside source.

Described in detail are toner patterns formed as a test pattern for a maintenance work of the image forming device 10 according to the embodiment with reference to FIG. 3 to FIG. 6. The toner patterns include a pattern for process controlling and a pattern for color matching, which are detected by the optical sensor 19, and serve for feedback adjustment of the image forming accuracy. The toner patterns further include a pattern for adjusting the toner density and a pattern for preventing blade-twisting.

Figure 3:
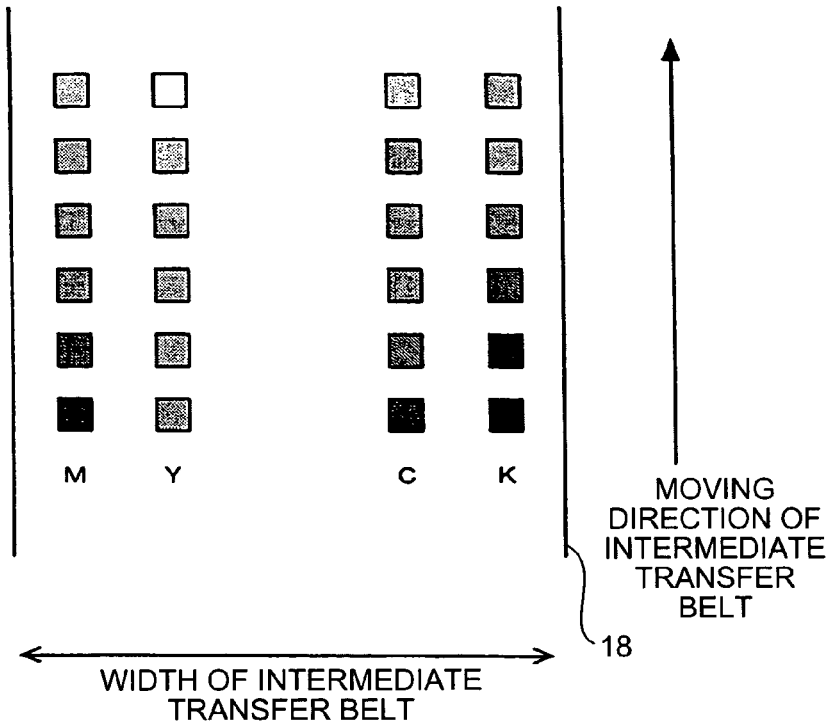
FIG. 3 is a diagram for explaining a pattern for process controlling in the embodiment.

FIG. 3 is a diagram for explaining a pattern for process controlling in the embodiment. The pattern for process controlling is used to adjust the toner density of an image. The pattern for process controlling includes square-shaped color patches that are respectively assigned a different color with the density gradually decreasing in the moving direction along intermediate transfer belt 18.

The patches for Y, M, C, and K colors are respectively aligned not to overlap one another in the moving direction of the intermediate transfer belt 18.

The pattern for process controlling is configured to be formed by being set starting and finishing positions of both main scanning and sub scanning based on count values of the main scanning counter 41 and the sub scanning counter 42.

Figure 4:
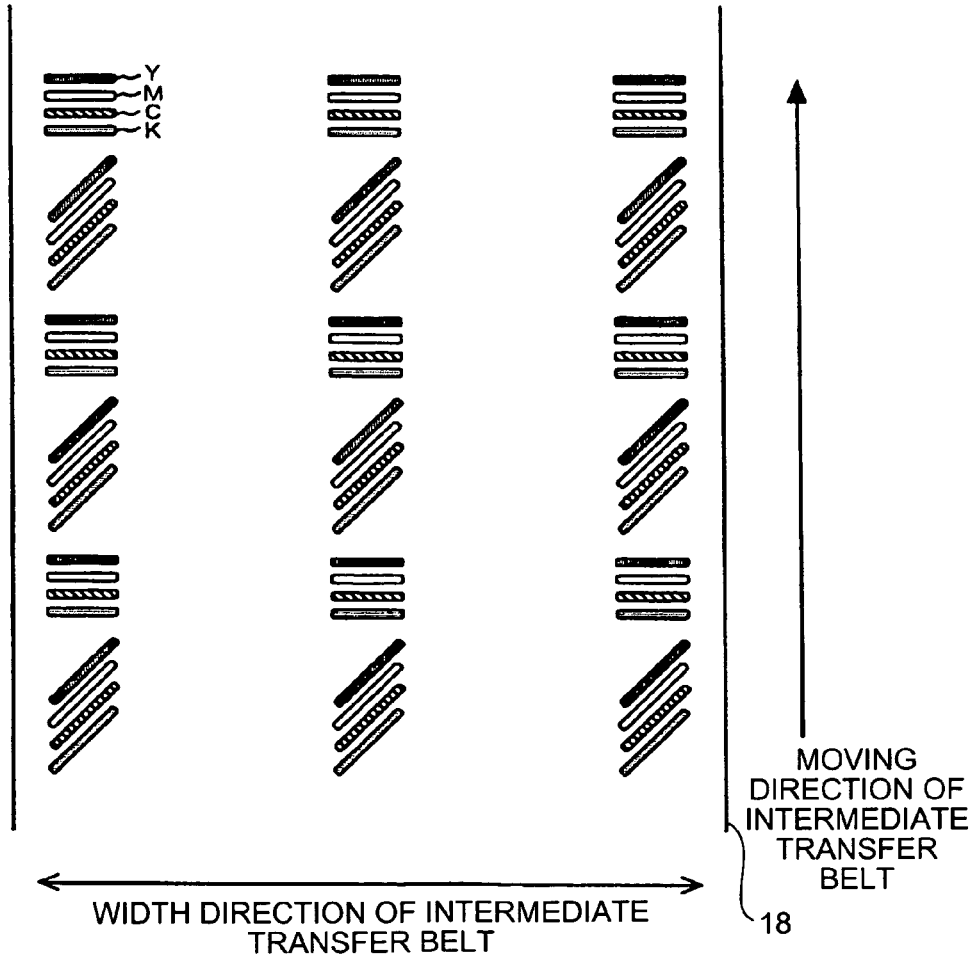
FIG. 4 is a diagram for explaining a pattern for color matching in the embodiment.

FIG. 4 is a diagram for explaining a pattern for color matching in the embodiment. The pattern for color matching will be described. The pattern for color matching is used for correcting a displacement of electrostatic latent images or toner images. The pattern for color matching includes two types of patch groups. One patch groups are arranged parallel to the main scanning direction, which is a width direction of the intermediate transfer belt 18. The other patch groups are arranged oblique at some angle, for example, a forty-five degree angle from the main scanning direction. The two types of patch groups are formed alternately in the moving direction of the intermediate transfer belt 18.

Each patch group consists of Y, M, C, and K color patches. The patch groups are formed in the middle and both sides of the intermediate transfer belt 18.

The patch groups, which are arranged parallel to the width direction of the intermediate transfer belt 18, are set by setting positions of starting and ending, of which positions of both main scanning and sub scanning are set based on count values of the main scanning counter 41 and the sub scanning counter 42. The other patch groups, which are arranged oblique at a forty-five degree angle from the main scanning direction, are set by setting a matching point with a predetermined bit count that is lower than count values of the main scanning counter 41 and the sub scanning counter 42.

Figure 5:
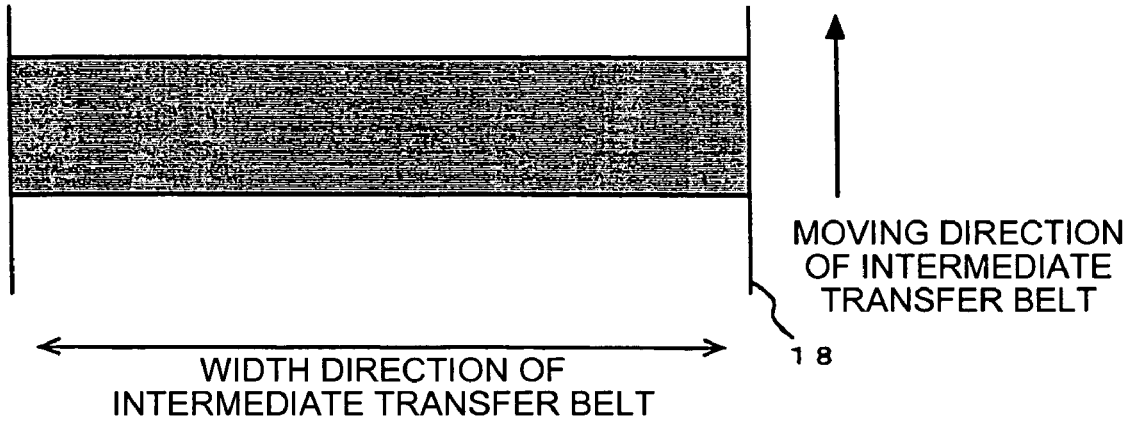
FIG. 5 is a diagram for explaining a pattern for adjusting a toner density in the embodiment.

FIG. 5 is a diagram for explaining a pattern for adjusting a toner density in the embodiment. The pattern for adjusting the toner density will be described. The pattern for adjusting the toner density is used for adjusting the density of a specific color toner. The pattern for adjusting the toner density is a rectangular-shaped solid color pattern, and formed across nearly the full width of the intermediate transfer belt 18. With the pattern for adjusting the toner density, the toner density is adjusted by consuming the toner.

A length of the pattern for adjusting the toner density in the moving direction of the intermediate transfer belt 18 can be set depending on a degree of the density to be adjusted, namely, an amount of the toner to be consumed. Determined are whether or not the density is to be adjusted, and if the density needs to be adjusted, determining the amount of the toner required for adjustment based on a detection signal from a toner amount detecting sensor provided in the developing device 16.

The pattern for adjusting the toner density is formed by setting a starting position and a finishing position of both main scanning and sub scanning according to count values of the main scanning counter 41 and the sub scanning counter 42.

Figure 6:
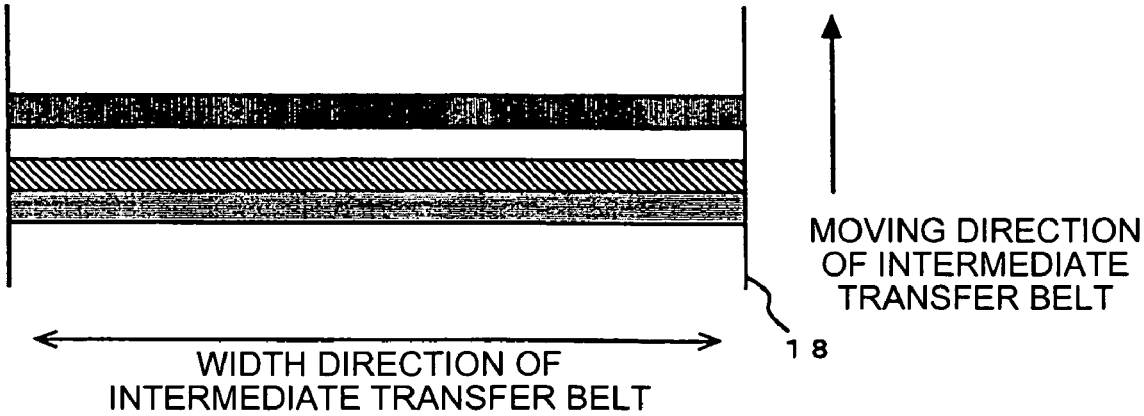
FIG. 6 is a diagram for explaining a pattern for preventing blade-twisting in the embodiment.

FIG. 6 is a diagram for explaining a pattern for preventing blade-twisting in the embodiment. The pattern for preventing blade-twisting is described with reference to FIG. 6. The pattern for preventing blade-twisting is used for preventing the cleaning blade of the transfer belt cleaning device 20 from twisting by attaching a certain amount of toner as a lubricant agent to the cleaning blade so as to reduce a friction between the cleaning blade and the intermediate transfer belt 18.

As shown in FIG. 6, the pattern for preventing blade-twisting includes rectangular-shaped solid color patterns, and is formed across nearly the full width of the intermediate transfer belt 18. The pattern for preventing blade-twisting consists of Y, M, C, and K toner patterns that are continuously formed contacting each other in the moving direction of the intermediate transfer belt 18.

A length of the pattern for preventing blade-twisting in the moving direction of the intermediate transfer belt 18 can be changed based on a condition of the cleaning blade of the transfer belt cleaning device 20, namely, an enough amount of prevention of blade twisting.

The pattern for preventing blade-twisting is formed by setting starting and finishing positions of both main scanning and sub scanning according to count values of the main scanning counter 41 and the sub scanning counter 42.

An instruction to form the toner pattern from the CPU 31 can be optionally changed. Namely, it is possible to change the settings of starting and finishing positions of both main scanning and sub scanning, a color of the toner pattern to be formed, and a starting time to output the toner pattern. Therefore, widths of main scanning and sub scanning, a starting position that depends on a timing, and an order to form the toner patterns can be changed by the CPU 31.

A method of forming the toner patterns in the image forming device 10 according to the embodiment is described below. In the image forming device 10, the pattern for process controlling is formed next to the pattern for preventing blade-twisting.

Figure 7:
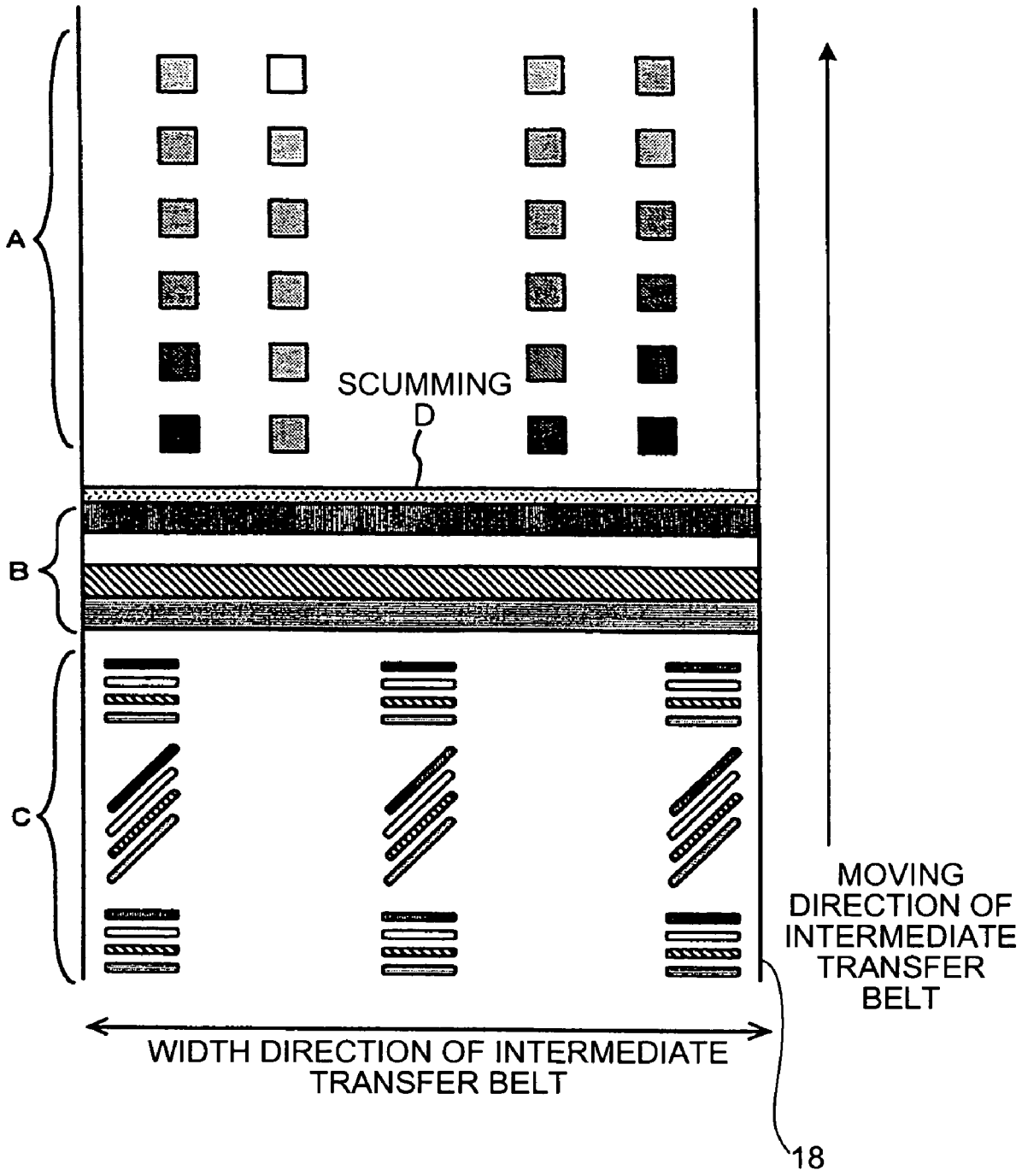
FIG. 7 is a diagram for explaining forming toner patterns in the image forming device shown in FIG. 1.
Figure 8:
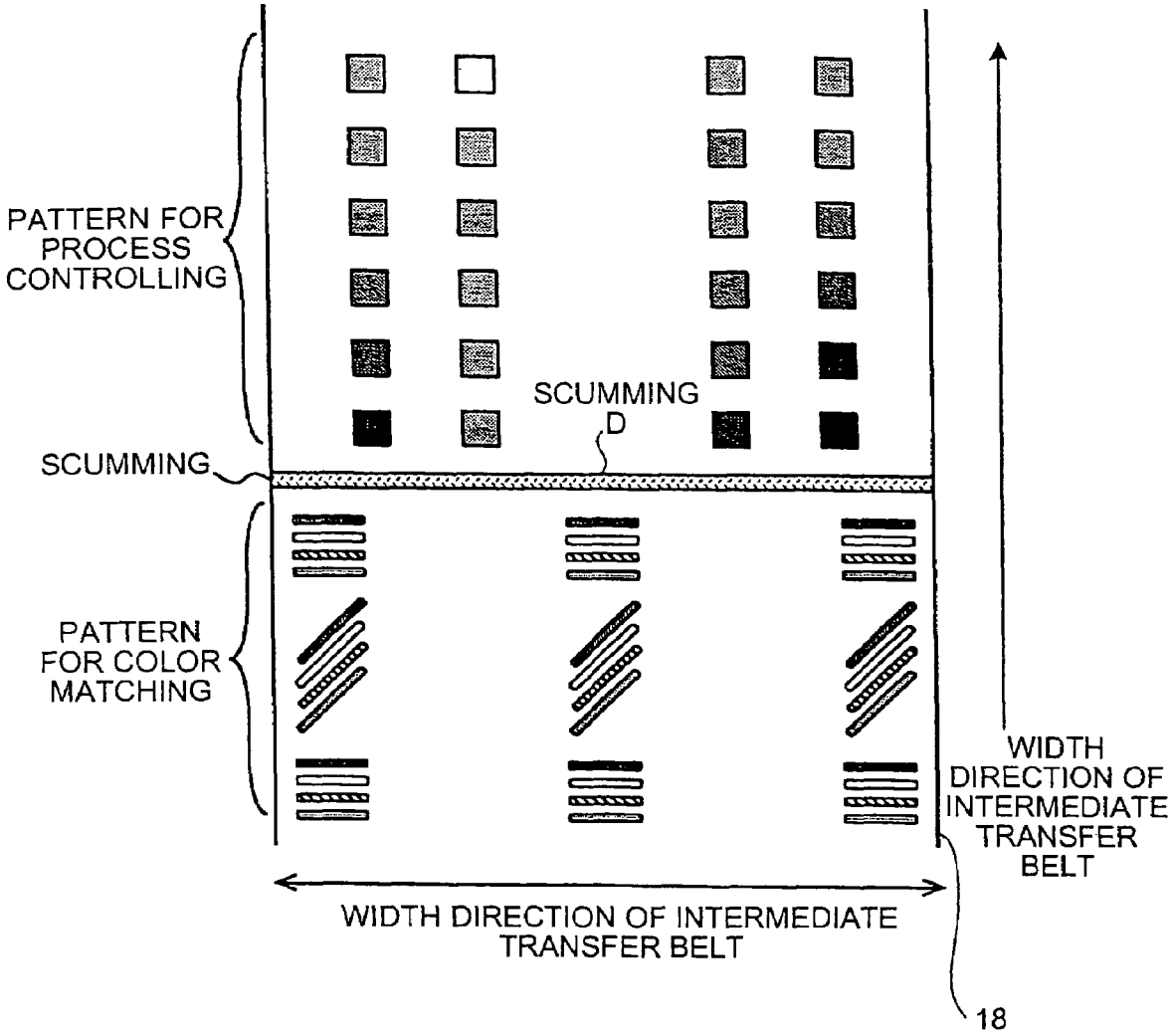
FIG. 8 is a diagram of the toner patterns for explaining an image forming device in a related art.

FIG. 7 is a diagram for explaining forming toner patterns in the image forming device 10 shown in FIG. 1. The forming is described in detail with reference to FIG. 7. Reference symbol A denotes the pattern for process controlling, B denotes the pattern for preventing blade-twisting, and C denotes the pattern for color matching. Reference symbol D denotes the scumming that uncontrollably occurs after the pattern for process controlling is formed.

The pattern for preventing blade-twisting is configured to be used for preventing the cleaning blade of the transfer belt cleaning device 20 from being twisted by a lubrication of a certain amount of toner supplied to the cleaning blade so as to reduce a friction between the cleaning blade and the intermediate transfer belt 18. Even though the pattern for preventing blade-twisting is stained by a certain degree of the scumming, the toner pattern for preventing blade-twisting can prevent the cleaning blade from being twisted due to the toner formed as if a lubricant.

Therefore, the CPU 31 controls the write controlling section 40 to form the pattern for preventing blade-twisting next to the pattern for process controlling, because the scumming occurs after the pattern for process controlling is formed. Thus, a time for cleaning the scumming can be saved, and the image forming device 10 can achieve high productivity.

Consequently, the pattern for preventing blade-twisting preferably is formed near the scumming. A position of the scumming is detected by the optical sensor 19 after the pattern for process controlling is formed.

An amount of a space between the pattern for process controlling and the pattern for preventing blade-twisting can be adjusted. More specifically, the amount can be adjusted such that the CPU 31 adjusts the sub scanning starting position of the pattern for preventing blade-twisting based on the sub scanning ending position of the pattern for process controlling. Therefore, even though a position of the scumming is not fixable, the pattern for preventing blade-twisting can be formed at an appropriate position.

A length of the pattern for preventing blade-twisting in the moving direction of the intermediate transfer belt 18 is adjusted depending on a condition of the cleaning blade of the transfer belt cleaning device 20, namely, being base on an enough amount to prevent the blade twisting. Therefore, an appropriate amount of toner can be supplied to the cleaning blade of the transfer belt cleaning device 20.

Furthermore, the CPU 31 controls the write controlling section 40 to form another toner pattern, for example, a pattern for color matching downstream of the pattern for preventing blade-twisting in the direction the intermediate transfer belt 18 advances as shown in FIG. 7. Therefore, the pattern for color matching is formed not to overlap the scumming. Thus, the color registration can be corrected accurately.

The pattern for preventing blade-twisting and the pattern for color matching are adjusted to be arranged at a predetermined interval. Namely, when the length of the pattern for preventing blade-twisting becomes longer/shorter in the moving direction of the intermediate transfer belt 18, the pattern for color matching is formed later/earlier by a balance of the length. Therefore, the pattern for color matching and the pattern for preventing blade-twisting are formed not to overlap each other. Thus, the toner patterns can be formed accurately and efficiently.

The predetermined interval between the pattern for preventing blade-twisting and the pattern for color matching can be retained by keeping a constant interval between the sub scanning ending position of the pattern for preventing blade-twisting and the sub scanning starting position of the pattern for color matching.

Instead of the pattern for color matching, the pattern for adjusting the toner density, as shown in FIG. 5, can be formed next to the pattern for preventing blade-twisting.

An image forming operation in the image forming device 10 according to the embodiment is described below.

When a document to be read is placed on the original glass plate 11, and the operation input receiving section 50 detects that a switch for copying is pushed to start copying the document, the CPU 31 instructs the reader 12 to read the document. The reader 12 project a laser beam to the document placed on the original glass plate 11, and receives a reflected light from the document.

Then, the CPU 31 controls the write controlling section 40 based on the image data of read contents of the document. The write controlling section 40 controls the optical scanner 13 based on the image data, and the optical scanner 13 projects the photosensitive drums 14 with a laser beam for writing.

The photosensitive drums 14, which are charged by the roller charging devices 15, are projected with the laser beam so as to be written with electrostatic latent images thereon.

The electrostatic latent images formed on the photosensitive drums 14 are developed by the developing devices 16 respectively provided corresponding to the photosensitive drums 14, so as to form toner images. The toner images are transferred onto the intermediate transfer belt 18 sequentially forming a full-color image on the intermediate transfer belt 18.

The full-color image formed on the intermediate transfer belt 18 is transferred onto a recording paper sheet by the paired transfer rollers 21, and then the fixing device 22 fixes the image onto the recording paper sheet at a certain temperature. The recording paper sheet with the full-color image thermally fixed thereto is discharged to the copy receiving tray 26, which is located outside the image forming device 10, by the paired copy receiving rollers 25.

The drum cleaning devices 17 remove and collect residual toners and the like from the photosensitive drums 14 after the toner images are transferred to the intermediate transfer belt 18. The transfer belt cleaning device 20 removes and collects residual toners and the like from the intermediate transfer belt 18 after the full-color image is transferred onto the recording paper sheet.

An adjustment operation in the image forming device 10 according to the embodiment is described below. The adjustment operation denotes adjusting the color registration by forming the toner patterns as described above.

The CPU 31 controls the write controlling section 40 to form a predetermined toner pattern at an appropriate timing. The write controlling section 40 controls the optical scanner 13 based on an instruction from the CPU 31, so that the optical scanner 13 projects a laser beam to the photosensitive drums 14 for writing.

When the photosensitive drums 14, which are charged by the roller charging devices 15, are projected with the laser beam for writing, electrostatic latent images are formed on the photosensitive drums 14 respectively.

The electrostatic latent images formed on the photosensitive drums 14 are respectively developed into toner images by the developing devices 16. The toner images are transferred onto the intermediate transfer belt 18 sequentially, and then full-color toner patterns are formed on the intermediate transfer belt 18.

Of the toner patterns formed on the intermediate transfer belt 18, the pattern for process controlling and the pattern for color matching are detected by the optical sensor 19. A result of detection by the optical sensor 19 is fed back to the CPU 31.

After the intermediate transfer belt 18 passes by the optical sensor 19, the toner patterns are removed and collected by the cleaning blade of the transfer belt cleaning device 20.

The adjustment operation by forming the toner patterns is performed every time the image forming device 10 is turned on and a certain number of recording paper sheets are fed through the image forming device 10. Furthermore, the adjustment operation is also performed at intervals during the image forming processing.

Although the embodiment of the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

For example, in the embodiment above, the tandem image forming device is described specifically. However, the embodiment of the present invention is not to be considered limited to the tandem image forming device. The present invention is also applicable to a one-drum type image forming device that includes only one image forming unit, which is provided one photoreceptor or one developing device.

In the image forming device 10 according to the embodiment of the present invention, the toner pattern for preventing blade-twisting can function properly to prevent the blade-twisting, even though a certain degree of scumming is retained on the intermediate transfer belt 18, by being formed downstream of the pattern for adjusting the toner density along the direction the intermediate transfer belt advances. Therefore, cleaning the scumming can be saved. Thus, the image forming device 10 can form images with high productivity. In addition, when another toner pattern is formed downstream of the pattern for preventing blade-twisting, the toner pattern is formed not to overlap the scumming, consequently, leading the color registration be corrected accurately.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming device including an electro-photographic image forming unit and an intermediate transfer belt, the electro-photographic image forming unit configured to form a toner image onto the intermediate transfer belt, and the intermediate transfer belt configured to transfer the toner image onto a transfer medium, the image forming device comprising:

a toner pattern forming unit that forms a first toner pattern and a second toner pattern downstream of the first toner pattern along a direction of advance of the intermediate transfer belt on the intermediate transfer belt, the first toner pattern including color patches of which a color density gradually differs so that a fluctuation of a toner supplying density can be detected by a sensor for a feedback adjustment of the fluctuation, and the second toner pattern for preventing a cleaning blade from being twisted by a friction from the intermediate transfer belt, when scrubbing, due to a toner-lubricating function thereof so as to maintain a cleaning ability of the cleaning blade.

2. The image forming device according to claim 1, wherein a distance between the first toner pattern and the second toner pattern on the intermediate transfer belt is variable.

3. The image forming device according to claim 1, wherein a length of the second toner pattern on the intermediate transfer belt along the direction of advance of the intermediate transfer belt is variable.

4. The image forming device according to claim 1, wherein the toner pattern forming unit forms a third toner pattern on the intermediate transfer belt downstream of the second toner pattern along the direction of advance of the intermediate transfer belt.

5. The image forming device according to claim 4, wherein the third toner pattern has a predetermined length on the intermediate transfer belt.

6. The image forming device according to claim 4, wherein the electro-photographic image forming unit is configured to form a full-color image by overlapping a plurality of different-color toner images onto the intermediate transfer belt, and the third toner pattern is for registering the plurality of different-color toner images.

7. The image forming device according to claim 4, wherein the third toner pattern is for registering a plurality of different color toner images.

* * * * *